US008360115B2

(12) United States Patent
Trattner et al.

(10) Patent No.: US 8,360,115 B2
(45) Date of Patent: Jan. 29, 2013

(54) FUEL TRANSFER SYSTEM

(75) Inventors: Matthew Trattner, Ridgewood, NJ (US); Michael Goetze, Ridgewood, NJ (US); Michael McAvey, Ridgewood, NJ (US); Pascal J. Ricatto, Ridgewood, NJ (US); Chris Smith, Hackettstown, NJ (US)

(73) Assignee: Fuel Tool LLC, Glen Rock, NJ (US)

( * ) Notice: Subject to any disclaimer, the term of this patent is extended or adjusted under 35 U.S.C. 154(b) by 666 days.

(21) Appl. No.: 12/523,397

(22) PCT Filed: Dec. 3, 2008

(86) PCT No.: PCT/US2008/085383

§ 371 (c)(1),
(2), (4) Date: Jul. 16, 2009

(87) PCT Pub. No.: WO2009/073710

PCT Pub. Date: Jun. 11, 2009

(65) Prior Publication Data

US 2010/0101659 A1 Apr. 29, 2010

Related U.S. Application Data

(60) Provisional application No. 60/991,815, filed on Dec. 3, 2007.

(51) Int. Cl.
*B65B 31/00* (2006.01)

(52) U.S. Cl. ..... 141/59; 141/231; 141/285

(58) Field of Classification Search ..... 141/59, 141/94, 192, 231, 285
See application file for complete search history.

(56) References Cited

U.S. PATENT DOCUMENTS

| | | | | |
|---|---|---|---|---|
| 3,603,481 | A | 9/1971 | Dilger et al. | |
| 3,774,654 | A * | 11/1973 | Hjermstad | 141/42 |
| 4,197,883 | A | 4/1980 | Mayer | |
| 4,675,780 | A | 6/1987 | Barnes et al. | |
| 5,102,012 | A * | 4/1992 | Foster | 222/40 |
| 5,135,258 | A | 8/1992 | Buxton | |
| 5,207,203 | A * | 5/1993 | Wagner et al. | 123/514 |
| 5,267,670 | A * | 12/1993 | Foster | 222/1 |
| 5,423,303 | A * | 6/1995 | Bennett | 123/527 |
| 5,694,988 | A | 12/1997 | Collins | |
| 6,283,320 | B1 | 9/2001 | Patch | |
| 6,786,245 | B1 * | 9/2004 | Eichelberger et al. | 141/4 |
| 6,792,966 | B2 | 9/2004 | Harvey | |
| 6,834,688 | B2 * | 12/2004 | Ono et al. | 141/94 |
| 2004/0221920 | A1 | 11/2004 | Ferguson et al. | |

OTHER PUBLICATIONS

International Search Report; PCT/US2008/085383 (Feb. 13. 2009).

* cited by examiner

*Primary Examiner* — Timothy L Maust
(74) *Attorney, Agent, or Firm* — Brinks Hofer Gilson & Lione

(57) ABSTRACT

A fuel transfer system for use with a motor vehicle of the type having a fuel tank and a fuel sending unit in the fuel tank for pumping fuel thorough a fuel line to the vehicles engine when the engine is idling where the fuel transfer system allows fuel in the fuel tank to also be delivered to an auxiliary fuel vessel such as another fuel tank, a fuel container, or an engine powered machine is provided. A fuel fitting for connecting the fuel line between a vehicle's fuel tank and engine to a fuel transfer system that can deliver fuel to an auxiliary fuel vessel is also described.

21 Claims, 8 Drawing Sheets

FUEL TRANSFER SYSTEM

CROSS REFERENCE TO RELATED APPLICATION

This application claims priority to PCT/US08/85383 filed on Dec. 3, 2008 and U.S. Provisional Application Ser. No. 60/991,815 filed on Dec. 3, 2007, the entire contents of which are incorporated herein by reference.

FIELD

This invention relates generally to a system and method for transferring a fluid from a main reservoir to a receiving reservoir. More particularly, this invention relates to a system and method for transferring a liquid fuel from a vehicle's fuel tank to an auxiliary fuel tank.

BACKGROUND

Vehicles, machines, and equipment powered by a combustion engine find wide use in a variety of applications. Examples of such vehicles, machines, and equipment include snow blowers, riding tractors, off-road vehicles, electrical generators, and lawn mowers, among others. There continually exists a need to be able to fill the fuel tanks of these vehicles, machines, and equipment in a safe and environmentally friendly manner. Many times it is necessary to transfer fuel to these vehicles, machines, and equipment when they run out of gas in a location that is a substantial distance from a fueling station. This filling operation is conventionally accomplished by either transporting the vehicle, machine, or equipment to the fueling station or by bringing a heavy portable container of gas from the fueling station to vehicle, machine, or equipment. Both of these options suffer from multiple drawbacks. First, transporting a vehicle, machine, or piece of equipment to a fueling station can be time consuming and costly. Second, transporting a portable fuel container from the fueling station to the vehicle, machine, or equipment is ergonomically difficult for the operator, as well as being both environmentally unfriendly due to the possibility that a spillage or accident could occur and a health hazard due to the dangers associated with siphoning.

Accordingly, there exists a continual need to provide a more effective means of transferring fuel to vehicles, machines, and equipment that have run out of fuel during use or operation.

SUMMARY

The present invention provides a fuel transfer system for use with a motor vehicle of the type having a fuel tank and a fuel sending unit in the fuel tank for pumping fuel thorough a fuel line to the vehicle's engine when the engine is idling. The fuel transfer system allows fuel in the fuel tank to be delivered to an auxiliary fuel vessel such as another fuel tank, a fuel container, or an engine powered machine. One embodiment of a fuel transfer system, constructed in accordance with the teachings of the present invention, generally comprises a fueling nozzle having a flow control valve for delivering the fuel to the auxiliary fuel vessel. The fueling nozzle may have a boot assembly used for capturing splashed fuel from the auxiliary fuel vessel. The fuel transfer system also has a fuel fitting in the fuel line that provides a fuel flow path from the fuel line to the fuel transfer system. A first fuel conduit is connected to the fuel fitting and in communication with the enclosure. The fluid transfer system further has a fuel valve that communicates with the first fuel conduit for controlling the flow of fuel in the fuel transfer system and a flow regulator connected with the first fuel conduit for controlling flow of the fuel delivered by the fueling nozzle. The flexible, second fuel conduit is in communication with the first conduit at the enclosure and to the fueling nozzle.

According to one aspect of the present invention, the fuel transfer system including the fueling nozzle, fuel fitting, first fuel conduit, enclosure, fuel valve, pressure regulator and flexible, second fuel conduit is electrically connected and grounded to the vehicle.

According to another aspect of the present invention, the fuel transfer system may further comprise a control panel mounted to the vehicle having an on-off switch connected to the vehicle's power supply and the fuel sending unit for providing power to the fuel sending unit when the vehicle's engine is not running. The on-off switch when activated is timed or set to turn off at a predetermined interval.

Another objective of the present invention is to provide a fuel fitting for connecting the fuel line between a vehicle's fuel tank and engine to a fuel transfer system that can deliver fuel to an auxiliary fuel vessel. The fuel fitting generally comprises a T-shape or Y-shape fitting having three coupled ends. One end of the fitting is coupled to the portion of the vehicle's fuel line that is connected to the engine. A second end of the fitting is coupled to the portion of the vehicle's fuel line that is connected to the fuel tank. The third end is coupled to the first fuel conduit of the fuel transfer system used to deliver fuel to the auxiliary fuel vessel through a fuel transfer system that includes a first fuel conduit, an enclosure, a fuel valve, a flow regulator, a flexible second fuel conduit, and a fueling nozzle.

Another objective of the present invention is to provide a fuel transfer system for use with a motor vehicle of the type having a fuel tank, a fuel sending unit in the fuel tank for pumping fuel thorough a fuel line to the vehicles engine, and a vapor recovery system for collecting fuel vapor in the fuel tank. In this embodiment, the fuel transfer system also allows fuel in the fuel tank to be delivered to an auxiliary fuel vessel such as another motor vehicle, a fuel container, or an engine powered machine. According to one aspect of this embodiment, the closed loop fuel transfer system comprises a fueling nozzle having a flow control valve for delivering the fuel to the auxiliary fuel vessel. The fueling nozzle may have a boot assembly for capturing not only splashed fuel but also fuel vapor from the auxiliary fuel vessel.

The fuel transfer system of this embodiment also comprises an enclosure mounted to the vehicle and a fuel fitting in the fuel line providing a fuel flow path from the fuel line to the fuel transfer system. A first fuel conduit is connected to the fuel fitting and in communication with the enclosure. A pressure regulator is connected with the first conduit for controlling pressure of the fuel delivered by the fueling nozzle, while a manual fuel valve or an electrically controlled fuel valve communicates with the first conduit for controlling the flow of fuel in the fuel transfer system. A flexible second fuel conduit is in communication with the first conduit at the enclosure and to the fueling nozzle. A first vapor line fitting is attached to the vehicle vapor recovery system and to the enclosure, with a second vapor line being coupled with the first vapor line at the enclosure and to the fueling nozzle's boot assembly. Finally, an electronic control system may be used for controlling the fuel valve wherein opening of the fuel valve enables fuel to flow through the fuel transfer system to the fueling nozzle to supply the fuel to the auxiliary fuel vessel. The boot assembly collects splashed fuel and sends fuel vapor to the vehicle vapor recovery system.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1A:
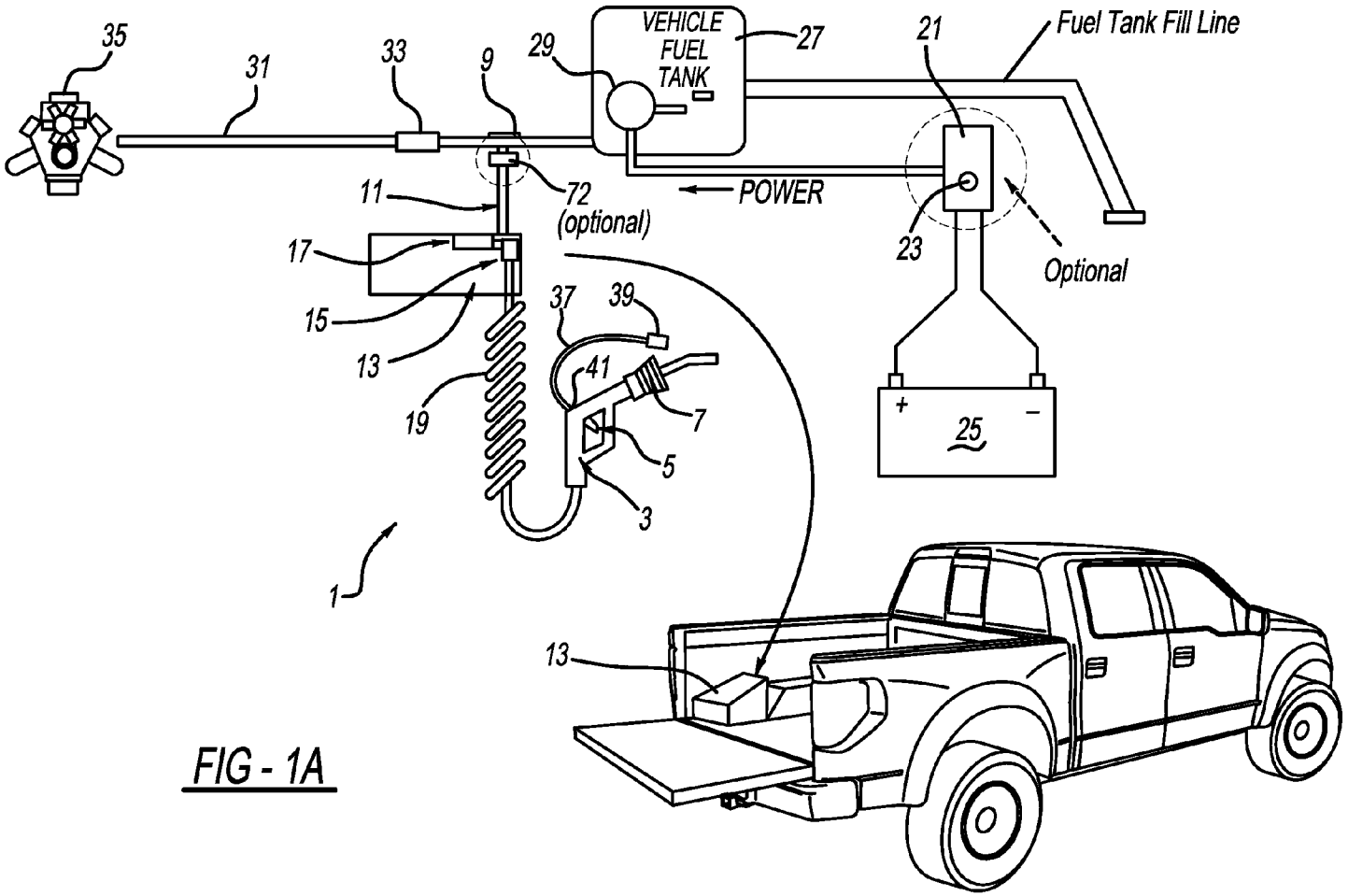
FIG. 1A is a schematic of a fuel transfer system according to one embodiment of the present invention.

The following description is merely exemplary in nature and is in no way intended to limit the present disclosure or its application or uses. It should be understood that throughout the description and drawings, corresponding reference numerals indicate like or corresponding parts and features.

Referring to FIG. 1A, the present invention generally provides a fuel transfer system 1 for use with a motor vehicle of the type having a fuel tank 27 and a fuel sending unit 29 in the fuel tank 27, which includes an electric motor driven fuel pump, for pumping fuel thorough a fuel line 31 to the vehicles engine 35 when the engine is running. The fuel transfer system 1 allows fuel in the fuel tank 27 to also be delivered to an auxiliary fuel vessel (not shown) such as another fuel tank, a fuel container, or an engine powered machine. The fuel transfer system 1 generally comprises a fueling nozzle 3 having a flow control valve 5 for delivering the fuel to the auxiliary fuel vessel (not shown). The fueling nozzle 3 has a boot assembly 7 for capturing splashed fuel from the auxiliary fuel vessel and a fuel fitting 9 in the fuel line 31 that provides a fuel flow path from the fuel line 31 to the fuel transfer system 1. A first fuel conduit 11 is connected with the fuel fitting 9 and in communication with an enclosure 13. The fuel transfer system 1 has a fuel valve 15 that can communicate with the first fuel conduit 11 for controlling the flow of fuel in the fuel transfer system 1 and an on-off flow valve-regulator 17 connected with the first fuel conduit 11 for controlling flow of the fuel delivered by the fueling nozzle 3. If desired, such valve 15 and/or regulator 17 may be included within the enclosure 13 or within the same housing. When the engine 35 of the vehicle is running (e.g., idling, etc.) the control of fuel is partially diverted from the fuel line 31 to the fuel transfer system 1 in such a manner that will not cause the engine 35 to stall or stop running. The fuel transfer system 1 further comprises a flexible, second fuel conduit 19 coupled to the first conduit 11 at the enclosure 13 and to the fueling nozzle 3. The fuel fitting 9 may be connected to the fuel line 31 in a location between the fuel tank 27 and the fuel line filter 33. Optionally, the enclosure 13 of the fuel transfer system 1 may be mounted to the vehicle, such as in the trunk or if a pick-up truck, in the bed of such truck. The enclosure 13 may include a holder for the fueling nozzle 3 that is vented external to the enclosure 13 through the use of a drip tube or other configuration.

Figure 1B:
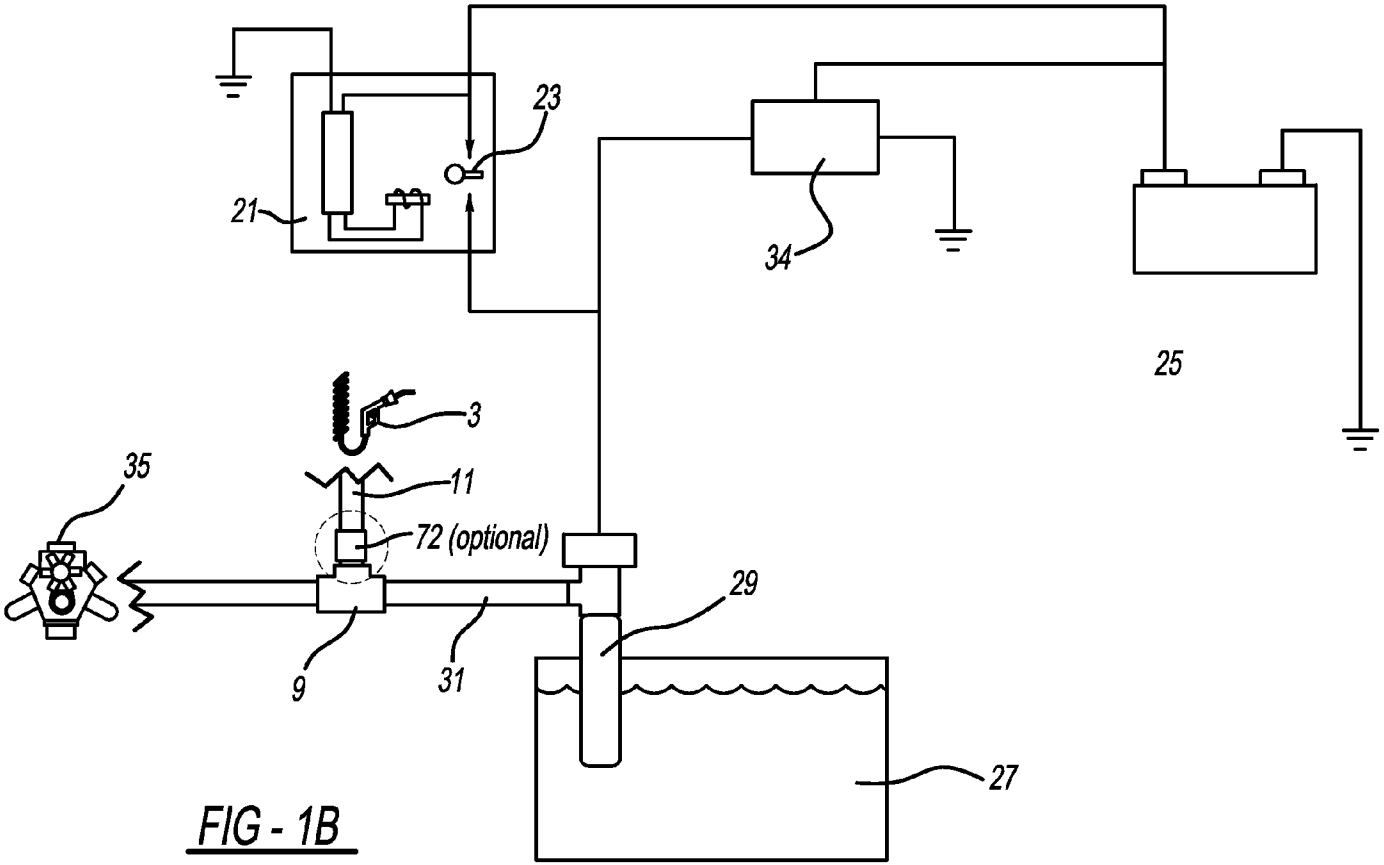
FIG. 1B is a schematic further depicting the optional electronic control for the fuel transfer system of FIG. 1A.

The fuel transfer system 1 is an easy to install system that allows the end-user to transfer liquid fuel (e.g., gasoline, E85, E95, diesel fuel, or other fuel) directly from a host motor vehicle's fuel tank 27 to the fuel tank of auxiliary equipment or vehicles, or a portable fuel container. The fuel fitting 9 may be coupled to the fuel line 31 using connectors or couplings that are compatible with existing fuel lines. In the embodiment as shown in FIGS. 1A and 1B, fuel is delivered from the host vehicle's fuel tank 27 to an auxiliary fuel tank by activating the vehicles OEM fuel sending unit 29 located inside the fuel tank 27 and drawing fuel directly from the vehicle's fuel tank 27 and passing it through the fuel fitting 9 that connects directly to the first conduit 11 of the fluid transfer system 1. The fuel then passes through the enclosure 13 to a bulkhead fitting on/off fuel valve-regulator 17, a fuel check valve 15, and finally through the flexible, second conduit 19, which is connected directly to a nozzle assembly 3 used for final delivery to the auxiliary fuel tank. The nozzle assembly 3 has its own spring loaded mechanical trigger 5, which is depressed in order for the fuel to flow out of the nozzle assembly 3. Optionally, a manual on-off ball valve or solenoid valve 72 may be located after the fuel fitting 9 in order to control the flow of fuel through the first conduit 11.

According to an optional aspect of the present invention shown in FIGS. 1A and 1B, the fuel transfer system 1 may be operated without turning the vehicle's engine on. In this aspect of the present invention, the system may be activated from a control panel 21 mounted to the vehicle having an on-off switch 23 connected directly to the vehicle's power supply (i.e., battery) 25 and the fuel sending unit 29 for providing power to the fuel sending unit 29 when the vehicle's engine is not running. The control panel 21 is preferably in communication with the vehicle's onboard computer 34. The on-off switch 23, which is preferably a single pull double throw (SPDT) automatic relay, is timed or set to turn off at a predetermined interval after activation. Optionally, the control panel 21 may include an audible or visible alarm that activates prior to or upon automatic shut-down. This timed function with a predetermined interval is beneficial in that accidently leaving the on-off switch in the on position will not cause the vehicle's power supply 25 to be drained. In addition, this automatic shut-off also provides some insurance against the auxiliary fuel vessel overflowing if the end-user is distracted or forgets to turn the switch 23 to its off position. A fuel transfer system 1 equipped with a control panel 21 allows an end-user without a driver's license access to fuel delivery without needing the keys to the vehicle's ignition. One skilled in the art will recognize that the predetermined interval can be set to any desired time. Preferably, the predetermined interval is about 2 minutes.

Figure 2:
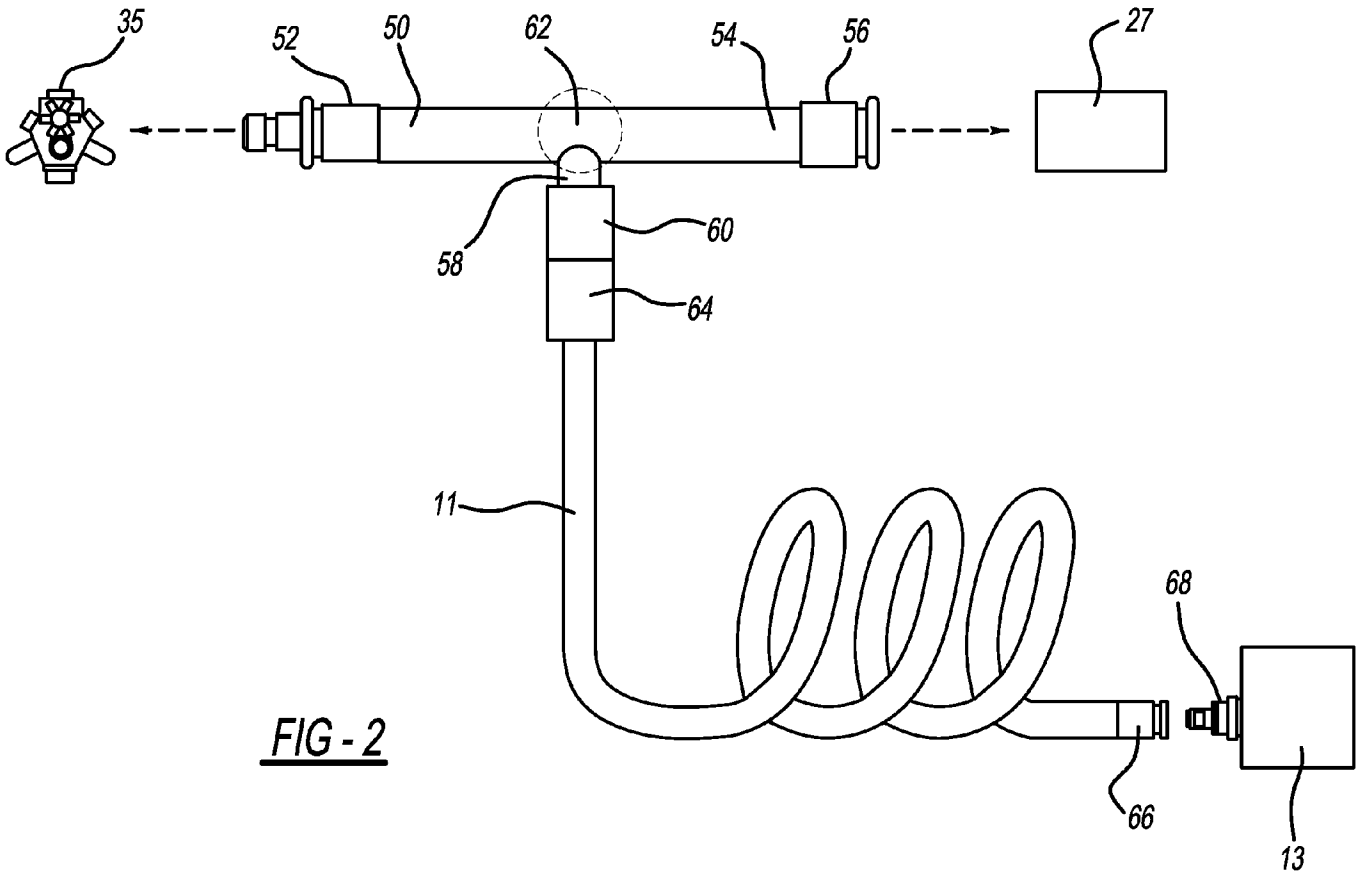
FIG. 2 is a schematic of a fuel fitting used in a fuel transfer system according to one aspect of the teachings of the present invention.

Another embodiment of the present invention generally relates to a fuel fitting for connecting the fuel line between a vehicle's fuel tank and engine to a fuel transfer system that can deliver fuel to an auxiliary fuel vessel. Referring to FIG. 2, the fuel fitting 9 generally comprises a T-fitting or a Y-fitting. The fuel fitting 9 comprises a first section 50, a second section 54, and a third section 58. The end 52 of the first section 50 is coupled to the portion of the vehicle's fuel line 31 that is connected to the engine 35. The end 56 of the second section 54 is coupled to the portion of the vehicle's fuel line 31 that is connected to the fuel tank 27. The end 60 of the third section 58 is coupled to the first fuel conduit 11 of the fuel transfer system 1 that is used to deliver fuel to the auxiliary fuel vessel. The first 50, second 54, and third 58 sections of the fuel fitting 9 are joined at a common intersection point 62.

The ends of the fuel fitting 9 that couple to the fuel line 31 or to the first fuel conduit 11 of the fuel transfer system 1 preferably use a coupling selected as one from the group of a threaded or locked barb connection 60, a clamp, or a male 52 or female 56 quick disconnect coupling. One skilled in the art will recognize that the connections between the various components in the fuel transfer system 1 can be of any type or form, including but not limited to threaded or locked barb connections 64, a clamp, and male 68 or female 66 quick disconnect couplings. The couplings may be any type of connector that will mate with an existing connector or coupling used with the fuel line 31 or first fuel conduit 11, including but not limited to, couplings that meet standard SAE J2044 (Society of Automotive Engineers, Troy, Mich.) entitled "Quick Connector Specification for Liquid Fuel and Vapor/Emissions Systems."

The fuel transfer system 1 including the fueling nozzle 3, fuel fitting 9, first fuel conduit 11, enclosure 13, fuel valve, on-off flow valve-regulator 17 and flexible, second fuel conduit 19 are electrically connected and grounded to the vehicle. This can be accomplished by having all of the components made out of a conductive material, such as a metal. When desirable, the body of the fuel fitting 9 may be comprised of a composite having a nylon inner layer and a rubber outer layer, the outer layer being adhered or clamped to the inner layer. The fuel fitting 9, as well as the flexible, second fuel conduit 19, may be inherently conductive when it is selected as one from the group of a conductive material (e.g., metal or conductive polymer, among others), a non-conductive material reinforced with conductive fillers, or a non-conductive material having a separate conductive element running the length of the conduit 19. The separate conductive element may be a conductive mesh of fibers or wires embedded within second fuel conduit 19 or fuel fitting 9. The second fuel conduit 19 may be comprised of multiple layers of different materials with the conductive element being located at the interface between two adjacent layers if desirable. Additionally, a grounding cable 37 that has a first end 41 and a second end 39 with the first end 41 being attached to the fueling nozzle 3 and the second end 39 being capable of engaging another grounded element may be used. For example, the second end 39 may include an alligator type clip that can be fastened to the frame of the auxiliary fuel tank, thereby assisting in making the entire fuel transfer system 1 electrically common or grounded.

Another unique feature of the fuel transfer system 1 is that the fuel can be delivered to an auxiliary fuel vessel in a metered, controlled manner. According to another embodiment of the present invention, when the nozzle 3 is inserted properly into the target fuel tank, the fuel transfer system 1 can form a completely sealed loop that ties back into the vehicle's existing vapor recovery system. The system 1 can be equipped with a safety timer that allows only a preset total amount of fuel to be delivered before automatically shutting down the vehicle's fuel pump 29 and the transfer system's 1 solenoid control valve. This allows the filling of auxiliary fuel tanks with significantly less environmental impact due to evaporation, vapor displacement, permeation and spillage than with traditional methods of refueling small engines or PFC's (Portable Fuel Containers).

Figure 3:
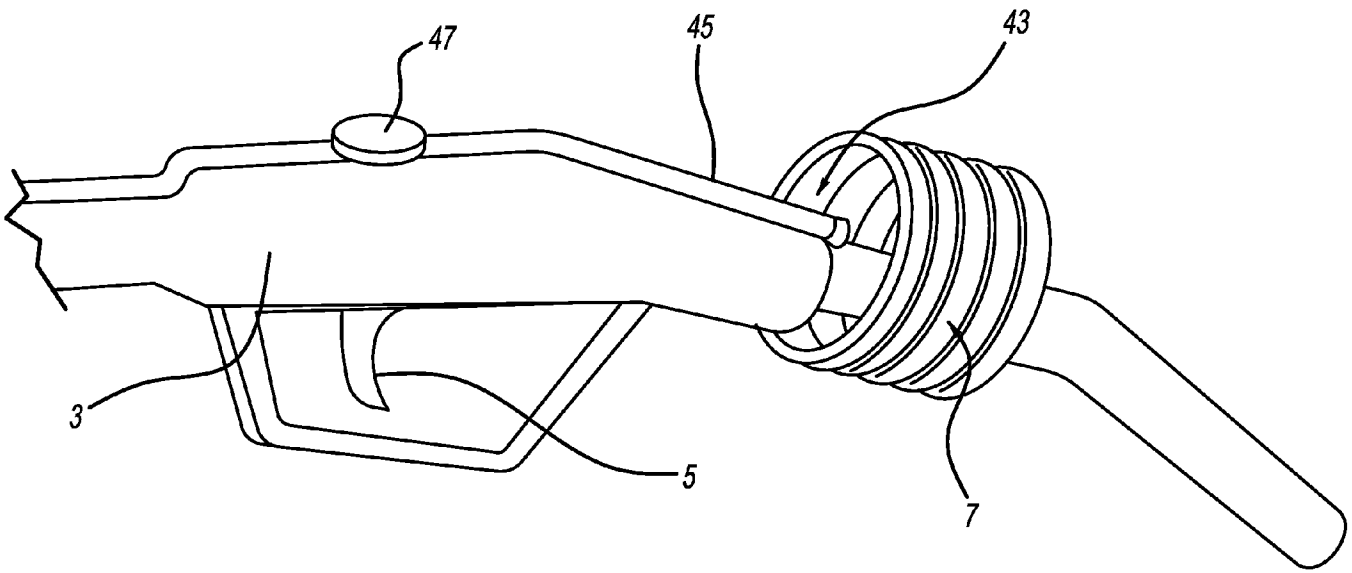
FIG. 3 is a schematic of a fueling nozzle assembly according to one aspect of the teaching of the present invention.

Referring to FIG. 3, the fuel transfer system 1 is preferably also equipped with a transparent recovery boot 7 and clear polycarbonate interface 43 on the nozzle 3 that has the nozzle 3 placed asymmetrically toward the rear of the interface. This allows the operator a better sight line to see into the target fuel tank by looking directly through the front of the interface. This design will discourage the operator from breaking the vapor seal multiple times during filling, helping to minimize evaporative losses. In addition, the nozzle assembly 3 may further include a vapor recovery tube 45 connected through the clear interface 43 into the recovery boot 7.

Figure 4:
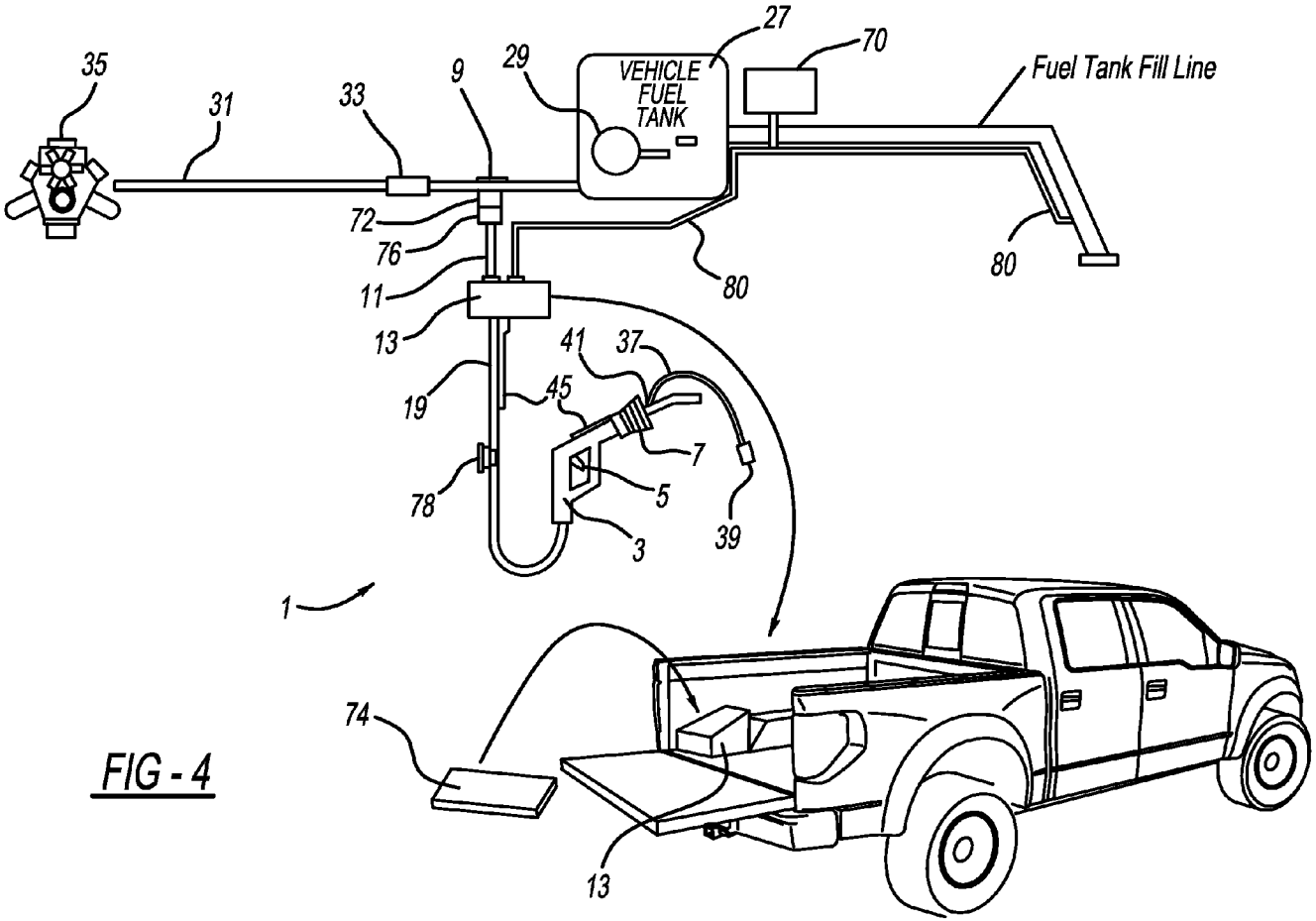
FIG. 4 is a schematic of a fuel transfer system according to another embodiment of the present invention.
Figure 5A:
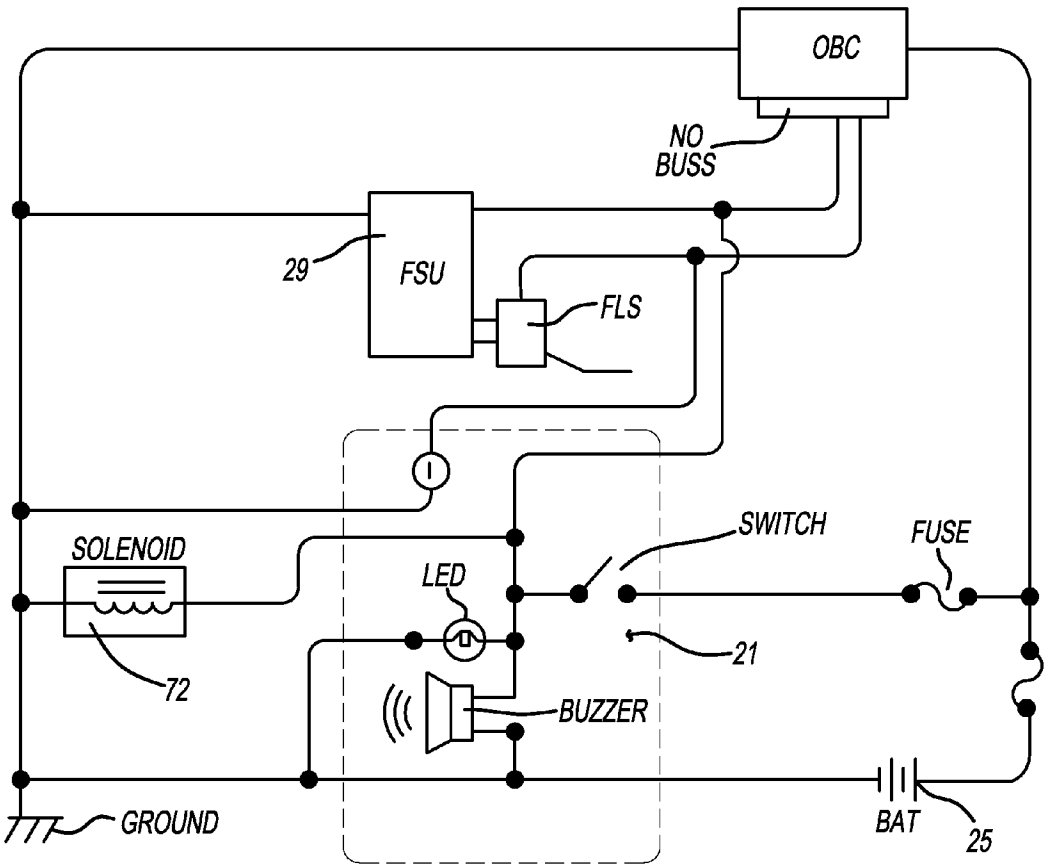
FIG. 5A is a schematic of the electrical system used with a fluid transfer system according to one embodiment of the present invention.
Figure 5B:
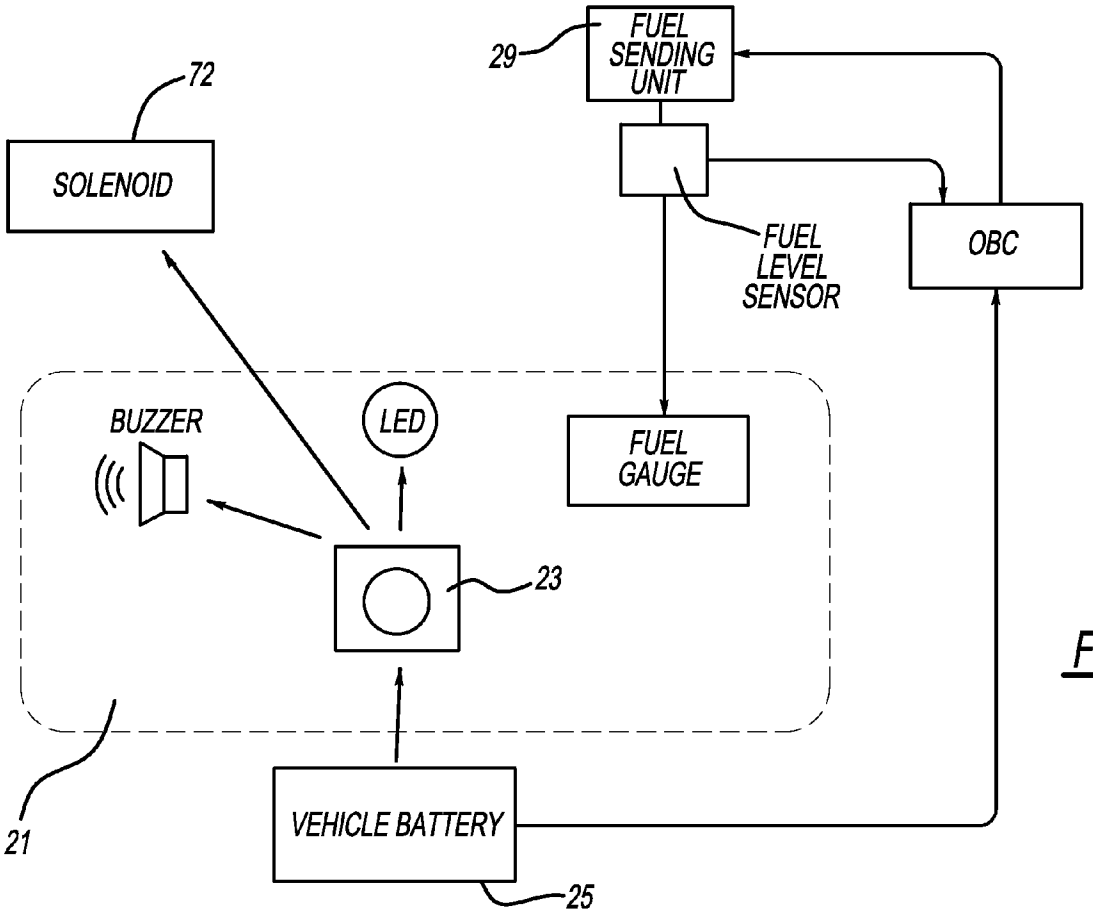
FIG. 5B is block flow diagram of the electrical system of FIG. 5A.

According to another aspect of the present invention as shown in FIG. 4, the fuel transfer system 1 may include the ability of vapor recovery by taking advantage of the already proven Onboard Refueling Vapor Recovery (ORVR) system 70 currently embedded in most newer motor vehicles. This allows refueling of target devices in the field to occur with the same attention to vapor recovery required (by EPA and/or CARB) for vehicles refueling at filling stations. In this embodiment, fuel is delivered to the auxiliary fuel tank by activating the vehicles OEM fuel sending unit 29 while simultaneously actuating a custom solenoid valve 72 to allow fuel flow to through the fluid transfer system 1. This may be accomplished electronically by interfacing a control panel 74 directly to the vehicles wiring harness between the on-board computer and fuel sending unit. The schematic and block diagram for the electrical system are shown in detail in FIGS. 5A and 5B. The control panel 74 is also equipped with a timer to preset the desired volume of fuel delivered. One skilled in the art will realize that the electrical system may be configured in any other manner in the art without deviating from the teachings of the present invention.

When activated, the OEM fuel sending unit 29 draws fuel directly from the vehicles fuel tank and passes it through the OEM fuel line 31. The fuel then enters a custom fuel fitting 9 connected to a solenoid 72 and regulator 76 of the fuel transfer assembly 1 and inserted either just upstream of the vehicles OEM fuel filter 33 or just downstream of the fuel sending unit 29. This fuel fitting 9 may be a specially designed T-fitting that either threads directly into the upstream side of the vehicles fuel filter 33 or connects directly to the downstream side of the fuel sending unit 29 using quick connect fitting. When the solenoid 72 is actuated, fuel exits the valve at about a 90° angle to the main fuel line and passes through the pressure regulator 76, which limits the fuel pressure in this auxiliary line. Fuel then flows through a grounded first conduit 11 that is connected to the enclosure 13 via a bulkhead fitting. The fuel then passes into the large fuel conduit of a flexible coiled dual conduit hose 19 which is connected to an inline volume meter 78. It then flows through another section of grounded conduit 19 which is connected to the refueling nozzle 3. The nozzle 3 has its own spring loaded mechanical trigger 5, which must be depressed in order for fuel to flow out of the nozzle.

When the nozzle assembly 3 is properly inserted into the target fuel tank, it forms a tight seal. This seal forces the vapor laden air which is exiting the target fuel tank into a small penetration through the clear polycarbonate plastic boot interface 43. This penetration may be connected by a tube 45 to the vapor recovery valve 47. This valve can connect directly to the smaller of the two conduits on the dual conduit hose 19 which is connected back to the enclosure 13 by a second bulkhead fitting. The bulkhead fitting is then connected to a vapor recovery line 80 that ties back into the vehicles OEM system 70. The connection to the ORVR 70 is made by simply placing a barbed T-fitting into the existing vapor recovery hose that originates from the neck of the vehicle's fuel tank. An additional grounding cable 37 of a specific length is attached directly from the fueling nozzle 3 to a spring loaded alligator clip 39. When properly fastened to the frame of the auxiliary fuel tank, this ground ensures electrical neutrality throughout the fuel transfer system 1.

Figure 6:
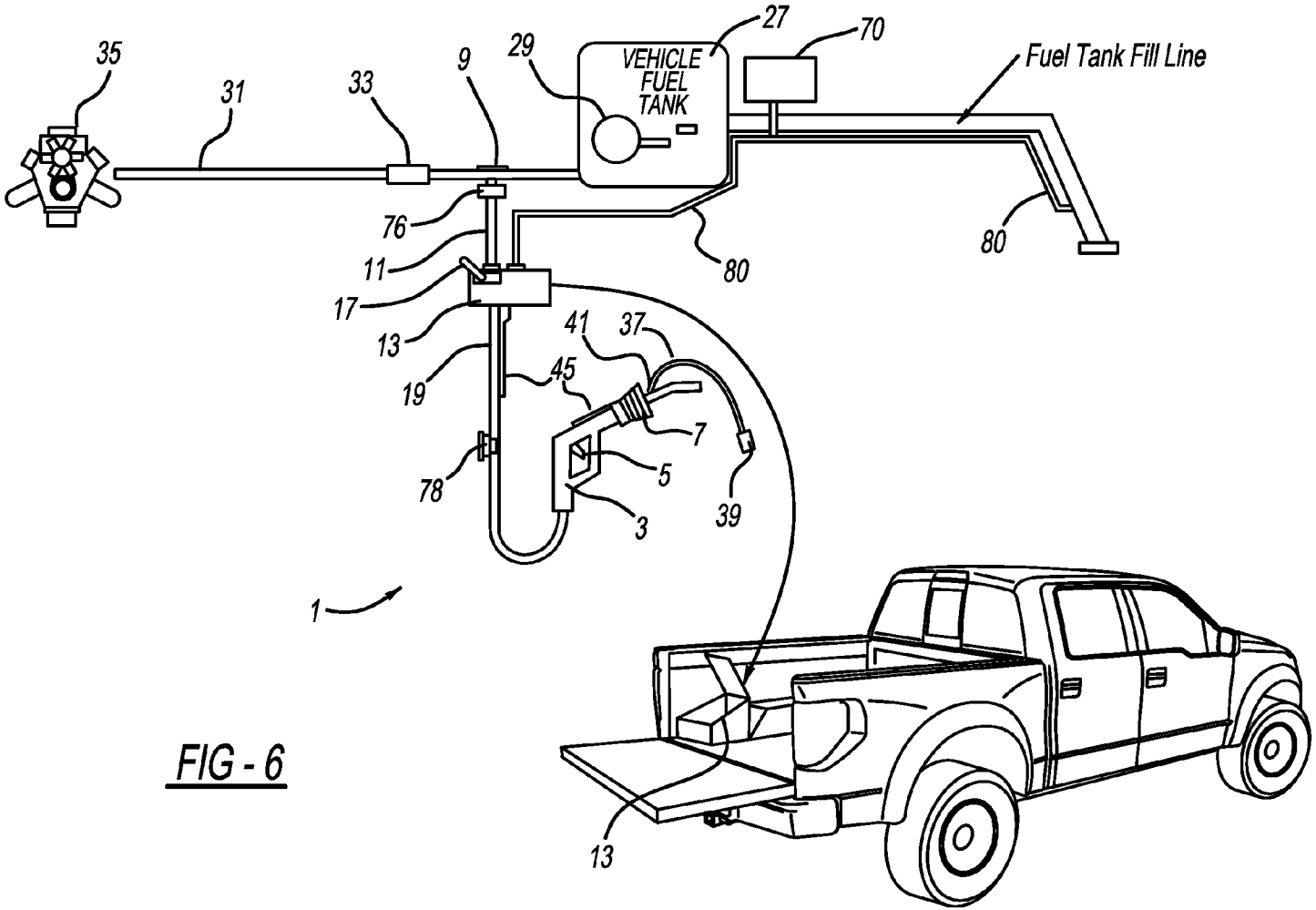
FIG. 6 is a schematic of a fuel transfer system according to another aspect of the present invention.

According to another aspect of this embodiment, as shown in FIG. 6 fuel can be delivered to the auxiliary fuel tank while the vehicle idles; this is accomplished by mechanically actuating an ON/OFF valve 17 that is integrated into the enclosure 13. When the fuel transfer system 1 is in use, the OEM fuel sending unit 29 draws fuel directly from the host vehicle's fuel tank 27 and passes it through the OEM fuel line 31. The fuel then enters a custom T-fitting 9 with a pressure regulator 76 assembly inserted either just upstream of the vehicles OEM fuel filter 33 or just downstream of the fuel sending unit 29. This assembly consists of a specially designed T-fitting 9 that either thread directly into the upstream side of the vehicles fuel filter 33 or connects directly to the fuel sending unit 29 using quick connect fitting. Fuel flows through the T-fitting 9 at about a 90° angle to the main fuel line and then passes through a pressure regulator 76 which limits the fuel pressure in this auxiliary line. Fuel then flows through a grounded conduit 11 that is connected to an ON/OFF valve 17 located after the bulkhead fitting on the inside of the enclosure 13. Fuel exiting the valve then passes into the large fuel conduit of a flexible coiled dual conduit hose 19 which is connected to an inline volume meter 78. It then flows through another section of grounded conduit 19 which is connected to the fueling nozzle 3. The nozzle 3 has its own spring loaded mechanical trigger 5, which must be depressed in order for fuel to flow out of the nozzle.

When the nozzle 3 and optional boot assembly 7 is properly inserted into the target fuel tank, it forms a tight seal. This seal forces the vapor laden air which is exiting the auxiliary fuel tank into a small penetration through the clear polycarbonate plastic boot interface 43. This penetration is connected by a vapor recovery tube 45 to the vapor recovery valve 47. This valve 47 connects directly to the vapor recovery line, which is the smaller of the two conduits on the dual conduit hose 19, is connected back to the enclosure 13 by a bulkhead fitting. The bulkhead fitting is then connected to a vapor recovery hose 80 that ties back into the vehicles OEM Onboard Refueling Vapor Recovery (ORVR) system 70. The connection to the ORVR 70 is made by simply placing a barbed T-fitting into the existing vapor recovery hose 80 that originates from the neck of the vehicle's fuel tank 27. An additional grounding cable 37 of a specific length is attached directly from the fueling nozzle 3 to a spring loaded alligator clip 39. When properly fastened to the frame of the auxiliary fuel tank, this ground ensures electrical neutrality throughout the fuel transfer system 1.

For safety purposes, the ON/OFF valve 17 may be purposely oriented so that its handle protrudes outside the enclosure 13 whenever it's in the open "ON" position. In this way, the operator can't close the enclosure 13 until they close the ON-OFF valve 17.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A fuel transfer system for use with a motor vehicle of the type having a fuel tank and a fuel sending unit in the fuel tank for pumping fuel thorough a fuel line to the vehicle's engine, the fuel transfer system allowing fuel in the fuel tank to also be delivered to an auxiliary fuel vessel such as another fuel tank, a fuel container, or an engine powered machine, the fuel transfer system comprising:

a fueling nozzle having a flow control valve for delivering the fuel to the auxiliary fuel vessel;

a fuel fitting in the fuel line providing a fuel flow path from the fuel line to the fuel transfer system;

an enclosure;

a first fuel conduit connected with the fuel fitting and in communication with the enclosure;

a fuel valve communicating with the first fuel conduit for controlling the flow of fuel in the fuel transfer system, the fuel valve located within the enclosure; and a flexible, second fuel conduit in communication with the first conduit at the enclosure and the fueling nozzle, the second fuel conduit and the fueling nozzle being stored within the enclosure when the fuel transfer system is not in use for allowing fuel in the fuel tank to be delivered into the auxiliary vessel, the fueling nozzle being removed from the enclosure and extending the second fuel conduit when the fuel transfer system is in use for allowing fuel in the fuel tank to be delivered into the auxiliary vessel.

2. The fuel transfer system of claim 1, wherein one or more of the fueling nozzle, the fuel fitting, the first fuel conduit, the enclosure, the fuel valve, the pressure regulator and, the flexible, second fuel conduit is adapted to be grounded to the vehicle.

3. The fuel transfer system of claim 2, wherein the flexible, second fuel conduit is adapted to be grounded to the vehicle and is made from a material selected from the group of a conductive material, a non-conductive material reinforced with conductive fillers, and a non-conductive material having a separate conductive element running the length of the conduit.

4. The fuel transfer system of claim 3, wherein the separate conductive element is a conductive fiber or a wire mesh embedded within the second fuel conduit.

5. The fuel transfer system of claim 2, further comprising a grounding cable having a first end and a second end, the first end being attached to the fueling nozzle and the second end capable of engaging another grounded element.

6. The fuel transfer system of claim 1, further comprising a control panel adapted to be mounted to the vehicle having an on-off switch connected to the vehicle's power supply and the fuel sending unit for providing electrical power to the fuel sending unit when the vehicle's engine is not running.

7. The fuel transfer system of claim 1, wherein the fuel fitting is a T-fitting or Y-fitting that makes a three way connection between the fuel-line communicating with the engine, the fuel-line coupled to the fuel tank and fuel sending unit, and the first fuel conduit.

8. The fuel transfer system of claim 7, wherein the fuel fitting uses a coupling to connect to the fuel line or fuel conduit that is one selected from the group of a threaded connection, a press-fit connection, and a quick disconnect coupling.

9. The fuel transfer system of claim 1 further comprising a solenoid valve located after the fuel fitting and prior to the enclosure;

wherein the solenoid valve can control the flow of fuel from the fuel line to the first fuel conduit.

10. A fuel transfer system for use with a motor vehicle of the type having a fuel tank, a fuel sending unit in the fuel tank for pumping fuel thorough a fuel line to the vehicle's engine, and a vapor recovery system for collecting fuel vapor in the fuel tank, the fuel transfer system allowing fuel in the fuel tank to be delivered to an auxiliary fuel vessel such as another motor vehicle, a fuel container, or an engine powered machine, the fuel transfer system comprising:

a fueling nozzle having a flow control valve for delivering the fuel to the auxiliary fuel vessel, an enclosure adapted to be mounted to the vehicle;

a fuel fitting in the fuel line providing a fuel flow path from the fuel line to the fuel transfer system, a first fuel conduit connected with the fuel fitting and in communication with the enclosure, a manual fuel valve or an electrically controlled fuel valve communicating with the first conduit for controlling the flow of fuel in the fuel transfer system, the manual or the electrically controller fuel valve being located within the enclosure, a flexible second fuel conduit connected with the first conduit at the enclosure and the fueling nozzle, a first vapor line fitting attached to the vehicle vapor recovery system and in communication with the enclosure, and a second vapor line coupled with the first vapor line at the enclosure and the fueling nozzle, the second fuel conduit, the second vapor line and the fueling nozzle being stored within the enclosure when the fuel transfer system is not in use for allowing fuel in the fuel tank to be delivered into the auxiliary fuel vessel, the fueling nozzle being removed from the enclosure and extending the second fuel conduit and the second vapor line when the fuel transfer system is in use for allowing fuel in the fuel tank to be delivered into the auxiliary vessel.

11. The fuel transfer system of claim 10, wherein at least one of the fueling nozzle, the fuel fitting, the first fuel conduit, the enclosure, the fuel valve, the flexible second fuel conduit is adapted to be grounded to the vehicle.

12. The fuel transfer system of claim 10, further comprising:

a control panel adapted to be mounted to the vehicle having an on-off switch connected to the vehicle's power supply and the fuel sending unit for providing electrical power to the fuel sending unit when the vehicle's engine is not running.

13. The fuel transfer system of claim 10, wherein the fuel fitting makes a three way connection between the fuel line coupled to the engine, the fuel line coupled to the fuel tank, the fuel sending unit, and the first fuel conduit.

14. The fuel transfer system of claim 10, further comprising a boot assembly having a plastic boot interface and a vapor recovery tube.

15. The fuel transfer system of claim 10, wherein the fueling nozzle further comprises a boot assembly for capturing splashed fuel from the auxiliary fuel vessel.

16. The fuel transfer system of claim 15, further comprising an electronic control system for controlling the fuel valve wherein opening of the fuel valve enables fuel to flow through the first conduit, the pressure regulator, the fuel valve, and the second conduit to the fueling nozzle to supply the fuel to the auxiliary fuel vessel and the boot assembly collecting fuel vapor which is sent to the vehicle vapor recovery system.

17. The fuel transfer system of claim 15, wherein the boot assembly further comprises a vapor recovery valve; the vapor recovery valve being coupled to the second vapor line.

18. The fuel transfer system of claim 1, further comprising a flow regulator connected with the first fuel conduit for controlling flow of the fuel delivered by the fueling nozzle.

19. The fuel transfer system of claim 6, further comprising wherein the on-off switch, when activated, is timed or set to turn off at a predetermined time interval.

20. The fuel transfer system of claim 10, further comprising a flow regulator connected with the first fuel conduit for controlling flow of the fuel delivered by the fueling nozzle.

21. The fuel transfer system of claim 12, further comprising; wherein the on-off switch, when activated is timed or set to turn off at a predetermined time interval.

* * * * *